US005573177A

United States Patent [19]

Hough

[11] Patent Number: 5,573,177

[45] Date of Patent: Nov. 12, 1996

[54] RECLOSABLE HINGED FLAP

[75] Inventor: Graham Hough, Chicago, Ill.

[73] Assignee: Field Container Company, L.P., Elk Grove Village, Ill.

[21] Appl. No.: 530,071

[22] Filed: Sep. 19, 1995

[51] Int. Cl.[6] ..... B65D 5/54

[52] U.S. Cl. ..... 229/207; 229/215; 229/221; 493/59; 493/183; 493/963

[58] Field of Search ..... 229/207, 215, 229/221, 243; 493/59–62, 128, 162, 183, 963

[56] References Cited

U.S. PATENT DOCUMENTS

| | | | |
|---|---|---|---|
| 1,585,494 | 5/1926 | Harvey | 229/221 |
| 2,228,181 | 1/1941 | Perryman | 229/221 |
| 3,185,377 | 5/1965 | Moore . | |
| 3,203,616 | 8/1965 | Bolton et al. | 229/221 |
| 3,397,833 | 8/1968 | Champlin | 229/221 |
| 3,549,079 | 12/1970 | Northrup | 229/215 |
| 3,568,910 | 3/1971 | McConnell . | |
| 3,853,261 | 12/1974 | Moore | 229/207 |
| 3,971,506 | 7/1976 | Roenna . | |
| 4,317,518 | 3/1982 | Mode | 229/207 |
| 4,569,443 | 2/1986 | Roccaforte . | |
| 4,706,875 | 11/1987 | Blackman . | |
| 4,738,365 | 4/1988 | Prater . | |
| 4,944,406 | 7/1990 | Zehnal | 229/207 |
| 5,000,320 | 3/1991 | Kuchenbecker | 229/221 |
| 5,007,542 | 4/1991 | Roccaforte . | |
| 5,035,330 | 7/1991 | Kuchenbecker | 229/207 |
| 5,114,013 | 5/1992 | Brown et al. | 229/216 |
| 5,169,059 | 12/1992 | Desmond et al. | 229/215 |
| 5,205,480 | 4/1993 | Roccaforte | 229/229 |
| 5,215,250 | 6/1993 | Roccaforte | 229/215 |
| 5,333,781 | 8/1994 | Roccaforte | 229/229 |

FOREIGN PATENT DOCUMENTS

| | | | |
|---|---|---|---|
| 678370 | 1/1964 | Canada | 229/221 |
| 2912717 | 10/1980 | Germany | 229/221 |

*Primary Examiner*—Gary E. Elkins

*Attorney, Agent, or Firm*—Marshall, O'Toole, Gerstein, Murray & Borun

[57] ABSTRACT

A carton blank and carton have a reclosable hinged flap formed from a panel and glue flap of the carton. The flap is opened by depressing a disengaging tab formed in another panel of the carton. The disengaging tab overlies a portion of the flap so that depression of the tab moves the flap to separate the flap from the remainder of the panel in which it is formed. Fifty-percent cuts through the carton panels are used to separate the flaps from the panels.

24 Claims, 4 Drawing Sheets

FIG. 7
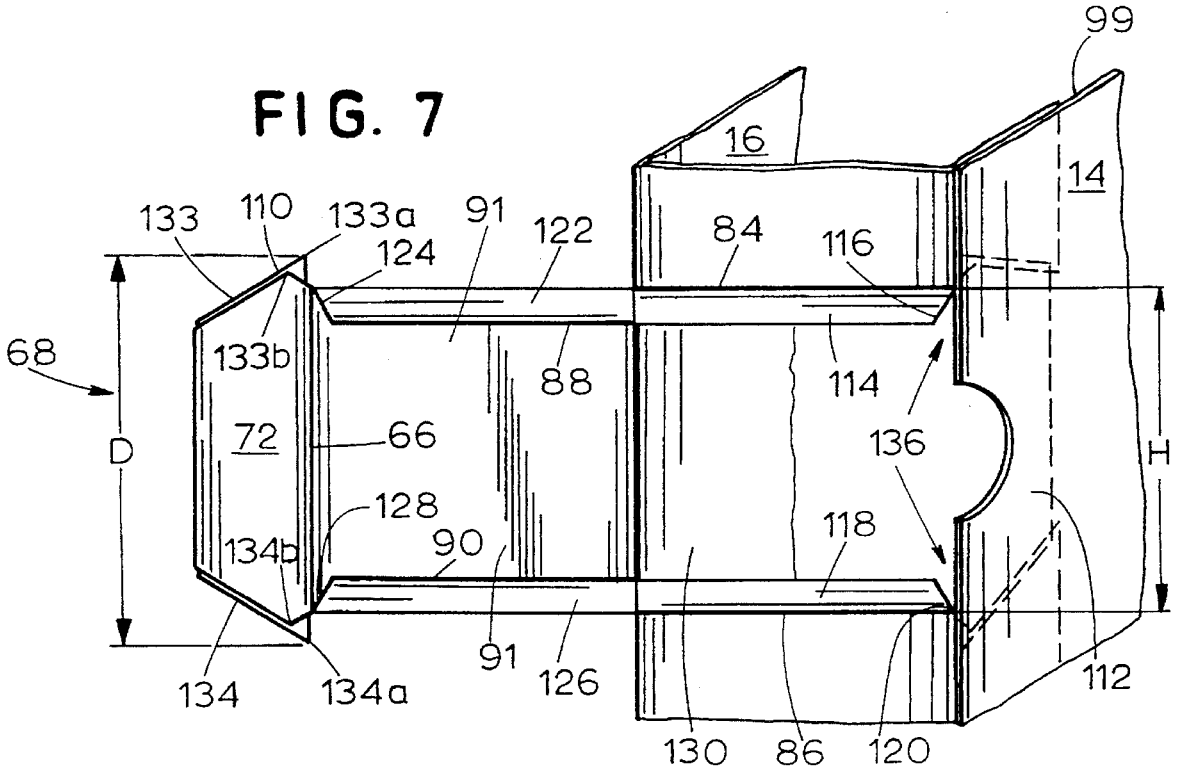
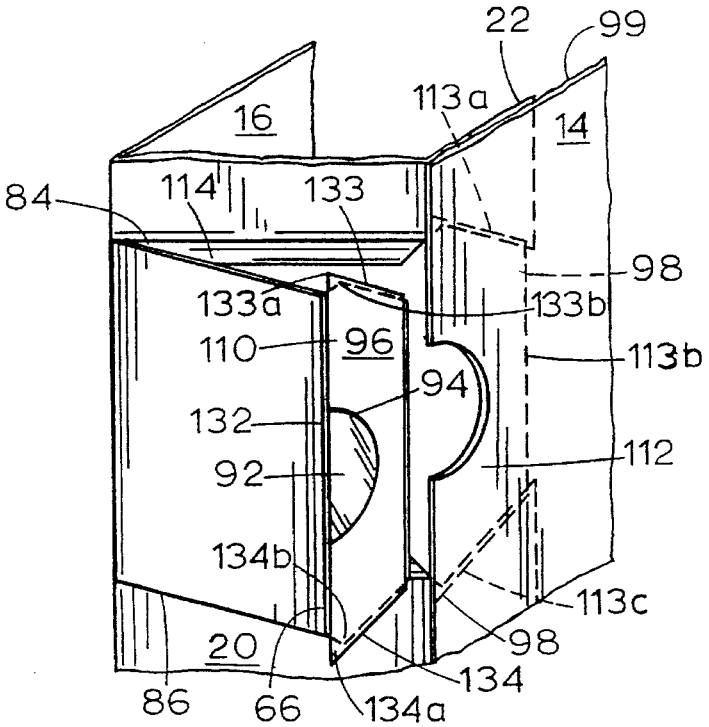
FIG. 6

RECLOSABLE HINGED FLAP

TECHNICAL FIELD

The present invention relates generally to cartons having flaps that open and close, and more particularly to paperboard cartons where a reclosable hinged flap is formed from the walls of the carton.

Background Art

Spouts and openings for paperboard cartons have been around for many years and have been developed and designed in a number ways. These different designs have been separately formed from metal, plastic, or paperboard or they have been integrally formed as part of the paperboard carton itself.

As illustrated by U.S. Pat. No. 5,000,320 to Kuchenbecker, many of these past devices use separate pieces of paperboard to form the opening and the closure tab. With this type of arrangement, two separate pieces of paperboard are needed to make one side panel, requiring the use of additional material and often wasting paperboard. Also, the configuration disclosed in Kuchenbecker requires adhesive to be placed in two separate places on the inner side panel of the carton. As a result, the Kuchenbecker configuration uses additional adhesive than would otherwise be needed for the carton and slows down production due to the requirement of the extra adhesive application step.

Additionally, older paperboard pour spouts or openings have been somewhat cumbersome to open. Most of these devices, Kuchenbecker for example, employ a tear strip that the consumer has to pull off before being able to open the closure flap. Often times, even after pulling off the tear strip, the closure flap itself was difficult to open.

As a result, there is a need for a reclosable paperboard carton that does not require additional panels to form the opening for the carton, utilizes a minimum of adhesive, and allows the consumer to easily open and close the carton.

SUMMARY OF THE INVENTION

According to one aspect of the present invention, a blank for forming a carton includes a first main panel, a second main panel connected to the first main panel, a side panel connected to the second main panel along a fold line, a glue flap connected to the side panel, a reclosable hinged flap that extends across the side panel and into the glue flap, a disengaging tab integrally formed in the first main panel and a number of end panels secured to the previously mentioned panels.

Preferably, a further side panel is connected between the first main panel and the second main panel, and the reclosable hinged flap includes a head portion and a neck portion connected to the head portion. The head portion may have an elongate hexagonal shape.

The neck portion of the reclosable hinged flap may include at least one pair of offset reverse cut score lines extending from the fold line to the head portion of the reclosable flap. Preferably, two pairs of offset reverse cut score lines are utilized. In addition, the disengaging tab may be scored for release.

The first main panel may include an inner surface and a separating area formed in the inner surface that surrounds and is connected to the disengaging tab. This separating area may have a trapezoidal shape.

The first main panel may have a top edge and the disengaging tab is, preferably, a first distance down from the top edge of the first main panel, and the glue flap has a top edge and the head portion of the reclosable flap is substantially the first distance away from the top edge of the glue flap.

According to another form of the present invention, a carton includes a plurality of side walls connected to one another, a top wall, a bottom wall, a glue flap attached to one of the side walls and adhesively secured to another of the side walls, a reclosable hinged flap formed in the one side wall, and a disengaging tab integrally formed in the other of the side walls.

A method of forming the carton includes creating a blank having a first main panel, a second main panel, at least one side wall, at least one top flap, at least one bottom flap, a glue flap, an integrally formed disengaging tab, an integrally formed reclosable hinged flap having a head portion, and a plurality of fold lines; folding the blank along the plurality of fold lines to form a top wall, a bottom wall, and at least one side wall with a side wall connected to the glue flap and the first main panel adjacent to the glue flap; adhering the glue flap to the inner surface of the first main panel while aligning the disengaging tab with the head portion of the reclosable hinged flap; adhering the at least one bottom flap to form the bottom wall; and adhering the at least one top flap to form the top wall and the carton.

BRIEF DESCRIPTION OF THE DRAWINGS

FIG. 6 is a fragmentary view similar to FIG. 4 illustrating the reclosable hinged flap in a partially open position; and FIG. 7 is a fragmentary view similar to FIGS. 4 and 6 illustrating the reclosable hinged flap in a fully open position.

DESCRIPTION OF THE PREFERRED EMBODIMENT

Figure 1:
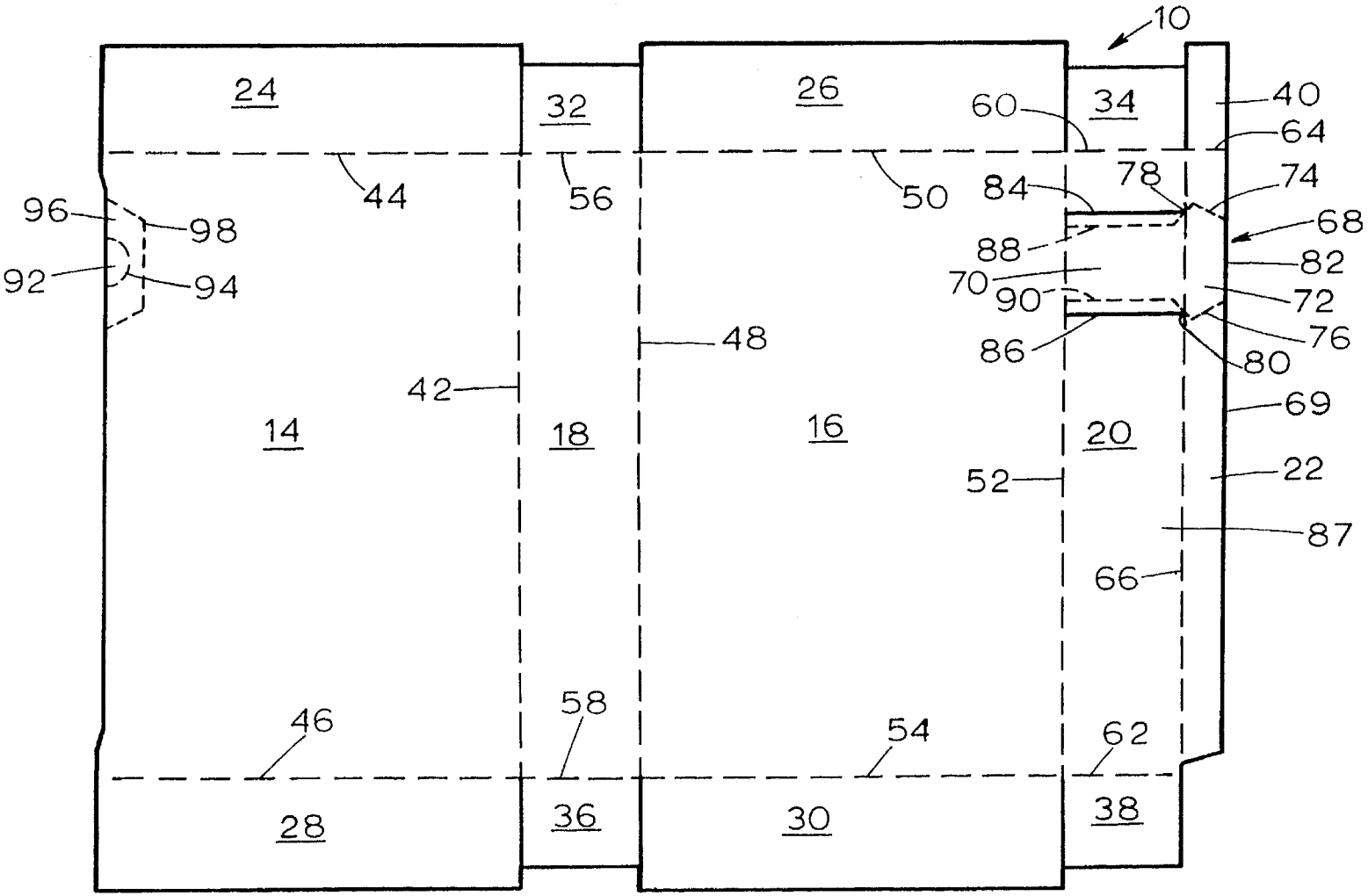
FIG. 1 is an elevational view of a cut, scored, and marked paperboard blank for forming a carton in accordance with the present invention.
Figure 3:
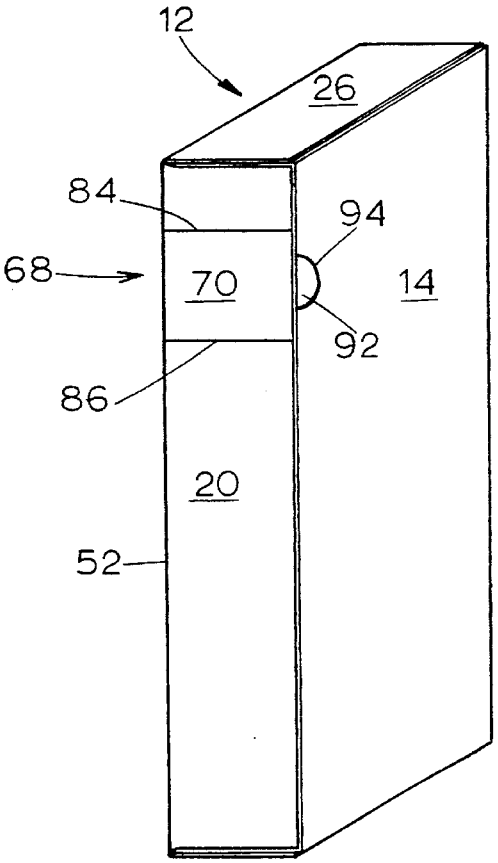
FIG. 3 is a perspective view of a completed carton formed from the paperboard blank of FIG. 1.

Referring initially to FIG. 1, a blank 10 is illustrated from which a carton 12, as shown in FIG. 3, can be formed. The blank 10 can be made from a paperboard material or other material conventionally used in carton formation. The blank 10 includes a front panel 14, a back panel 16, a first side panel 18, a second side panel 20, and a glue flap 22. The blank 10 further includes top end panels 24 and 26, bottom end panels 28 and 30, and minor flaps 32, 34, 36, 38, and 40. Full cuts (cuts that extend through the entire thickness of the paperboard material) separate the end panels and flaps 24, 26, 28, 30, 32, 34, 36, 38, and 40 laterally from each other to allow each end panel or flap to be freely folded inward.

Figure 2:
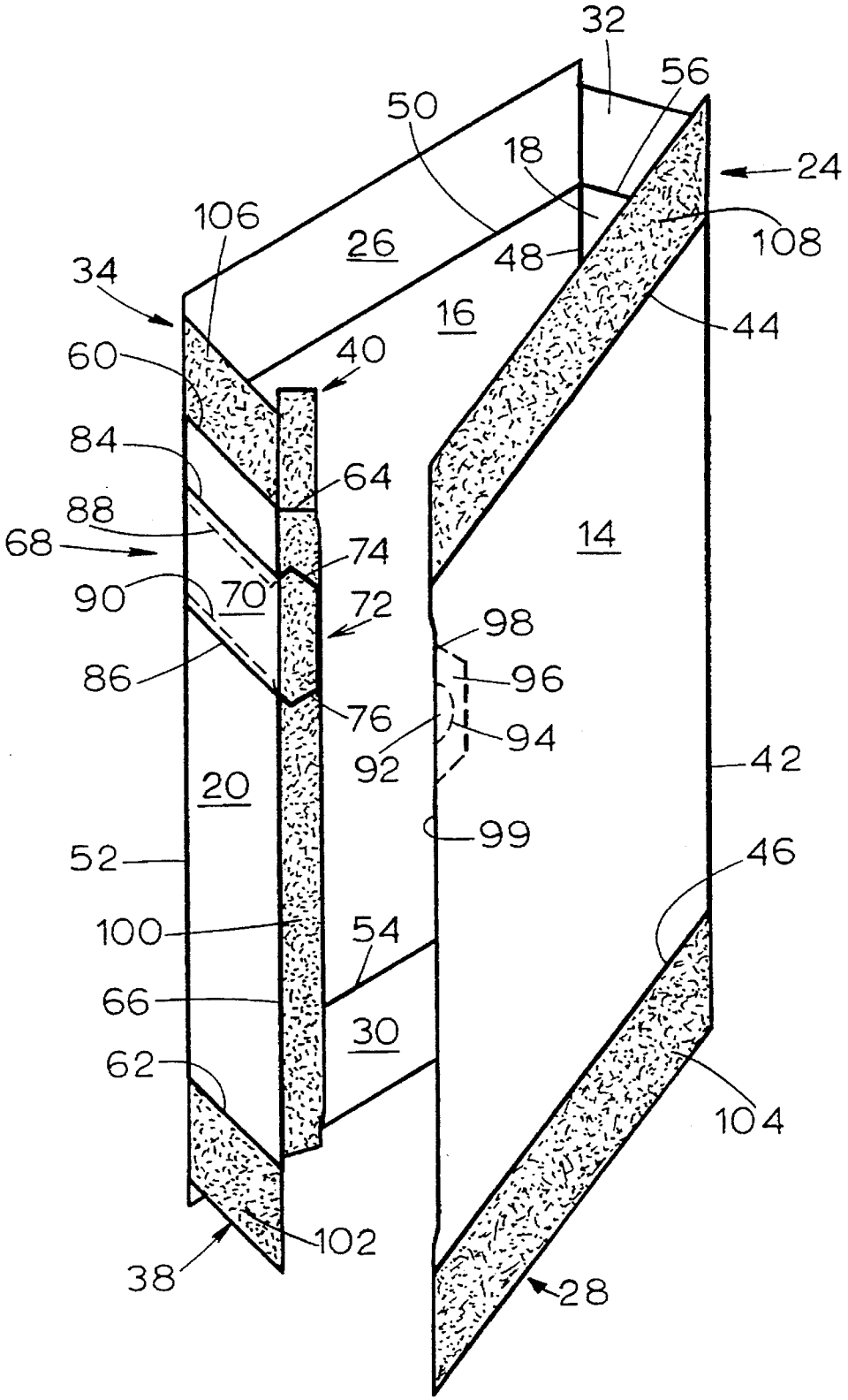
FIG. 2 is a perspective view of the carton partially formed with adhesive applied.

Focusing now on the connections between some of the elements of the blank 10, the front panel 14 is hingedly connected to the first side panel 18 by a fold line 42 and is hingedly connected to the top end panel 24 and the bottom end panel 28 by fold lines 44, 46, respectively. Fold lines are preferably defined by, but not limited to, crimping, some form of marking or some other line-forming process, or adjacent elements of the blank 10 having a common edge. Likewise, the back panel 16 is hingedly connected to the first side panel 18 by a fold line 48 and to the top end panel 26, the second side panel 20, and the bottom end panel 30 by fold lines 50, 52, and 54, respectively. The minor flaps 32 and 36 are hingedly connected to the first side panel 18 by fold lines 56 and 58, respectively. Similarly, minor flaps 34 and 38 are hingedly connected to the second side panel 20 by fold lines 60 and 62, respectively. The minor flap 40 is hingedly connected to the glue flap 22 by a fold line 64, and the glue flap 22 is hingedly connected to the second side panel 20 by a fold line 66. Consequently, as illustrated in FIG. 2, a carton can be formed by folding the blank 10 along the previously described fold lines.

The blank 10 also includes a reclosable hinged flap 68. The reclosable hinged flap 68 is integrally formed in the second side panel 20 and the glue flap 22, extending across the second side panel 20 from the fold line 52 to an outer edge 69 of the glue flap 22. The reclosable hinged flap 68 has a neck portion 70 and a head portion 72. The neck portion 70 spans the full width of the second side panel 20, and the head portion 72 of the reclosable hinged flap 68 spans the full width of the glue flap 22. The head portion 72 is defined by the fold line 66, a portion 82 of the outer edge 69, a pair of elongate perforations 74 and 76, and a pair of short perforations 78 and 80. A perforation is a paperboard cut that intermittently cuts through the entire thickness of the paperboard material while leaving intermittent pieces of the paperboard material attached. As a result, an element of the blank 10 defined by a perforation is still attached to adjacent elements. The separation of an element defined by a perforation occurs when a separating force is applied to the element. For example, a person pulling on the head portion 72 will separate the head portion 72 from the glue flap 22 along the perforations 74, 78 and 76, 80. Finally, when the elements that define the head portion 72; 66, 74, 76, 78, 80, and 82; are taken together, the head portion 72 may have an elongate hexagonal shape.

As seen in FIGS. 1–4 and 6, the neck portion 70 of the reclosable hinged flap 68 is defined by the fold line 52, the fold line 66, and a pair of partial-cut score lines 84 and 86 extending partially into the second side panel 20 from an outer surface 87 thereof and further extending preferably linearly from the fold line 52 to the fold line 66. All of the partial-cut score lines mentioned herein are cut to a depth of approximately 50% of the thickness of the paperboard material. As seen in FIG. 7, when viewed from an inner surface 91 of the reclosable hinged flap 68, the neck portion 70 is defined by the fold lines 52 and 66 again, and by a pair of partial-cut score lines 88 and 90 that partially extend into the second side panel 20 through the inner surface 91. The partial-cut score lines 88 and 90 are preferably offset inwardly from the partial-cut score lines 84 and 86. Furthermore, the partial-cut score lines 88 and 90 extend linearly from the fold line 52, then at a first distance L from the fold line 66, the partial-cut score lines 88 and 90 angle obliquely outward until they intersect the fold line 66. At that intersection point, the partial-cut score lines 88, 90 also intersect the short perforations 78, 80, respectively. Additionally, the pairing of inner surface and outer surface partial-cut score lines 84, 88 and 86, 90 creates sets of offset reverse cut score lines.

Figure 4:
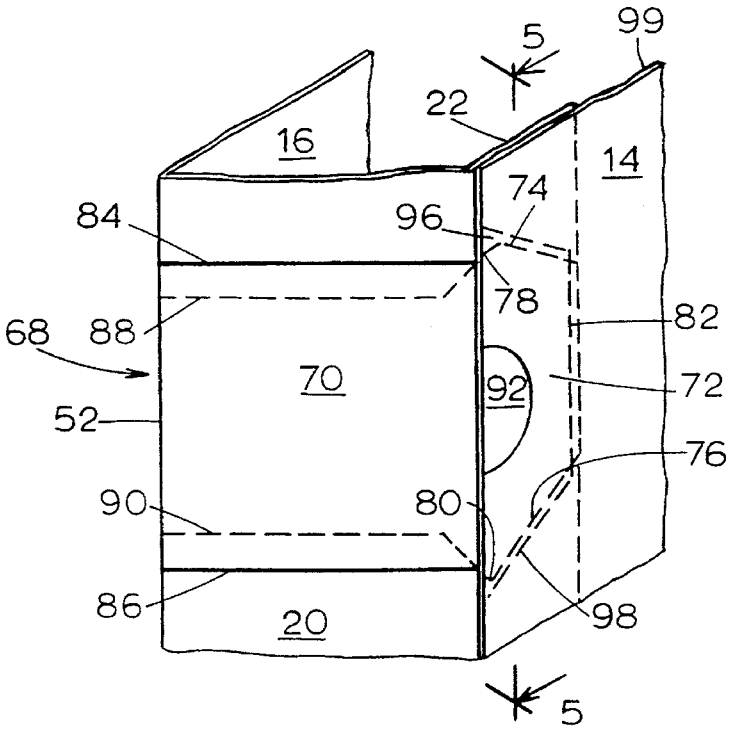
FIG. 4 is a fragmentary enlarged view of a portion of the carton of FIG. 3, illustrating the reclosable hinged flap in a closed position.
Figure 5:
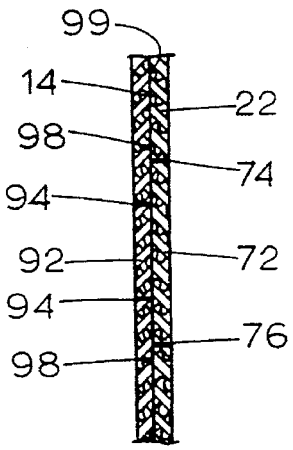
FIG. 5 is a fragmentary sectional view taken along the line 5—5 of FIG. 4 illustrating the different cuts and perforations in the paperboard blank of FIG. 1.

A disengaging tab 92 is located in the front panel 14. The disengaging tab 92 is positioned so that it is in registration with the head portion 72 of the reclosable hinged flap 68 when the carton 12 is formed, as illustrated in FIG. 4. A perforation line 94 outlines and defines the shape of the disengaging tab 92 and allows release thereof from the remainder of the front panel 14. A separating area 96 surrounds the disengaging tab 92. The separating area 96 is defined by a partial-cut score line 98, which is a 50% cut through the thickness of an inner surface 99 of the front panel 14 (FIG. 5). The separating area 96 can be formed in a trapezoidal shape and is designed to be larger than the head portion 72 for closure purposes that will be discussed in greater detail later.

FIG. 2 illustrates the formation of the carton 12 in greater detail. The front panel 14 and the back panel 16 are folded about the first side panel 18 along the fold lines 42 and 48, and the second side panel 20 and the glue flap 22 are folded about the fold lines 52, 66. Subsequently, a layer 100 of glue or other adhesive is applied along the length of the outer surface of the glue flap 22. At this point, the inner surface 99 of front panel 14 is adhered to the outer surface of the glue flap 22 while aligning the separating area 96 to cover and extend beyond the head portion 72 of the reclosable hinged flap 68 (FIG. 4). Next, the minor flaps 36 and 38 are folded inward along the fold lines 58 and 62. A further layer 102 of glue or other adhesive is applied to the outer surfaces of the minor flaps 36 and 38. The bottom end panel 28 is then folded inward along the fold line 46 so that the inner surface of the bottom end panel 28 adheres to the outer surfaces of the minor flaps 36 and 38. A further layer 104 of glue or other adhesive is applied along the length of the outer surface of the bottom end panel 28. Thereafter, the bottom end panel 30 is folded inward along fold line 54 so that the inner surface of the bottom end panel 30 adheres to the outer surface of the bottom end panel 28. At this point, a product may be placed into the partially formed carton before closing the top minor flaps and end panels.

After filling, the minor flap 40 is folded inward along the fold line 64. Next, the minor flaps 32 and 34 are folded inward along the fold lines 56 and 60. The minor flap 40 provides extra support to the minor flap 34. A layer 106 of glue or other adhesive is applied to the outer surfaces of the minor flaps 32 and 34. The top end panel 24 is then folded inward along the fold line 44 so that the inner surface of the top end panel 24 adheres to the outer surfaces of the minor flaps 32 and 34. A layer 108 of glue or other adhesive is subsequently applied along the length of the outer surface of the top end panel 24. To finish the formation of the carton 12, the top end panel 26 is folded inward so that the inner surface of the top end panel 26 adheres to the outer surface of the top end panel 24. FIG. 3 illustrates the completed carton after assembly while FIG. 4 shows that the separating area 96 covers and extends beyond the head portion 72 of the reclosable hinged flap 68. FIG. 4 also shows the location of the disengaging tab 92 relative to the reclosable hinged flap 68. FIG. 5 illustrates the various cuts made in the front panel 14 and the glue flap 22.

FIG. 6 illustrates the present invention after the disengaging tab 92 has been pressed inward to open the carton 12. By pressing the disengaging tab 92 inward, it separates from the front panel 14 along the partial-cut score line 94. At the same time, the separating area 96 that surrounds and is attached to the disengaging tab 92 separates from the front panel 14 along the partial-cut score line 98. Since the partial-cut score line 98 is a 50% cut through the thickness of the inner surface 99 of the front panel 14, a ply separation occurs in the separating area 96 as the disengaging tab 92 is pushed inward. The separating area 96 separates into two parts during the ply separation: a closure portion 110 and a recess portion 112. The recess portion 112 is defined by edges 113a, 113b, 113c of the front panel 14. The closure portion 110 includes a neck edge 132, a top edge 133, and a bottom edge 134. The neck edge 132 is the edge of the closure portion 110 that is closest to the neck portion 70. The intersection of the neck edge 132 with the top edge 133 creates a corner 133*a*. Similarly, the intersection of the neck edge 132 with the bottom edge 134 also creates a corner 134*a*.

As a result of the ply separation, the closure portion 110 is now attached to and remains with the disengaging tab 92, and is also attached to and covers the head portion 72 of the reclosable hinged flap 68. Therefore, when the disengaging tab 92 is pressed inward causing the ply separation in the separating area 96, the head portion 72 is simultaneously being separated from the glue flap 22 along the elongate perforations 74, 76 and the short perforations 78, 80. Subsequently, as the disengaging tab 92 is pulled outward, the neck portion 70 of the reclosable flap 68 separates from the second side panel 20 since the neck portion 70 is attached to the head portion 72. The neck portion 70 separates from the second side panel 20 along the pairs of offset reverse cut score lines 84, 88 and 86, 90 causing ply separation. FIG. 7 shows the ply separation along the offset reverse cut score lines 84, 88 and 86, 90 which creates a first top lip 114 with an oblique edge 116 and a first bottom lip 118 with an oblique edge 120 on the second side panel 20. The ply separation also forms a second top lip 122 with an oblique edge 124 and a second bottom lip 126 with an oblique edge 128 in the neck portion 70 of the reclosable hinged flap 68. In the fully open position of FIG. 7, an opening 130, defined by the top lip 114, the bottom lip 118, the front panel 14 and the back panel 16, is created, and the product within the container can be freely dispensed therethrough.

The oblique edges 116, 120 of the lips 114, 118 and the recess portion 112 define an opening 136 in the second side panel 20 having a height H. To close the reclosable hinged flap 68, the closure portion 110 is inserted through the opening 136. The corners 133*a*, 134*a* of the closure portion 110 are spaced a distance D apart that is greater than the height H of the opening 136. (The corners 133*b* and 134*b* of the head portion 72 are also spaced apart a distance greater than the height of the opening 136.) Therefore, when the closure portion 110 is pushed all the way in, an interference fit is created between the corners 133*a*, 34*a* and the second side panel 20. This interference fit keeps the carton 12 sealed and prevents product from spilling out. In addition, the ply separation of the separating area 96 creates rough mating surfaces on the closure portion 110 and the recess portion 112. These rough surfaces help provide resistance to lateral movement when the reclosable hinged flap 68 is closed. Rough mating surfaces are also created on the top and bottom lips 114, 118, 122, 126 during the ply separation. Therefore, when the reclosable hinged flap 68 is closed, the first top lip 114 remates with the second top lip 122 and the first bottom lip 118 remates with the second bottom lip 126. The remating creates overlaps between the lips. The overlapping, in conjunction with the roughness of the mating surfaces, helps prevent product from passing between the edges of the reclosable hinged flap 68 and the second side panel 20.

The reclosable hinged flap of the present invention has a number of advantages. It reduces the amount of paperboard and glue required per box, and thus, saves material costs. It also is more efficient since its configuration requires that one strip of adhesive be applied to the glue flap rather than requiring adhesive to be applied at several points on the glue flap. The present invention is also easily opened by consumers. There are no tear strips which need to be removed.

Even though the invention has been described with reference to preferred embodiments, anyone skilled in the art should understand that the invention can be practiced in other ways than as specifically described herein without departing from the spirit and scope of the invention. It is, therefore, to be understood that the spirit and scope of the invention be limited only by the appended claims. The above described reclosable hinged flap can be incorporated in a variety of paperboard blanks used for containing products wherein it is desired to dispense such products from the carton when needed. The reclosable hinged flap can be formed in any of the side walls as well as the top and bottom wall of the carton described.

I claim:

1. A blank for forming a carton, comprising:

a first main panel;

a second main panel connected to the first main panel;

a side panel connected to the second main panel along a line;

a glue flap connected to the side panel;

a reclosable hinged flap extending across the side panel and into the glue flap, the reclosable hinged flap having a head portion and a neck portion connected to the head portion, wherein the head portion has a first height and separation of the neck portion from the side panel creates an opening having a second height which is less than the first height;

a disengaging tab integrally formed in the first main panel; and a plurality of end panels secured to the panels.

2. The blank of claim 1, further comprising a further side panel connected between the first main panel and the second main panel.

3. The blank of claim wherein:

the first main panel comprises an inner surface and a separating area formed on the inner surface connected to the head portion;

and the separating area has a third height greater than the second height.

4. The blank of claim 1 wherein the head portion of the reclosable hinged flap has an elongate hexagonal shape.

5. The blank of claim 1 wherein the neck portion of the reclosable hinged flap includes at least one pair of offset reverse cut score lines extending from the line to the head portion of the reclosable hinged flap.

6. The blank of claim 1 wherein the neck portion of the reclosable hinged flap includes two pairs of offset reverse cut score lines extending from the line to the head portion of the reclosable hinged flap.

7. The blank of claim 1 wherein the disengaging tab is scored for release.

8. The blank of claim 7 wherein the first main panel includes an inner surface and a separating area formed on the inner surface that surrounds and is connected to the disengaging tab.

9. The blank of claim 8 wherein the separating area has a trapezoidal shape.

10. The blank of claim 8 wherein the first main panel has a top edge and the disengaging tab is a first distance down from the top edge of the first main panel, and wherein the glue flap has a top edge and the head portion of the reclosable hinged flap is substantially the first distance down from the top edge of the glue flap.

11. A carton, comprising: at least a first side wall, a second side wall and a third wall connected to one another, a top wall and a bottom wall;

a glue flap attached to the first side wall and adhesively secured to the third side wall;

a reclosable hinged flap formed in the first side wall having a head portion and a neck portion secured to the head portion, wherein the head portion has a first height and separation of the neck portion from the first side wall creates an opening having a second height which is less than the first height; and a disengaging tab integrally formed in the third side wall.

12. The carton of claim 11 wherein the third side wall comprises an inner surface and a separating area formed on the inner surface connected to the head portion;

and the separating area has a third height greater than the second height.

13. The carton of claim 11 wherein the head portion of the reclosable hinged flap has an elongate hexagonal shape.

14. The carton of claim 11 wherein the first side wall has an edge opposite the glue flap and wherein the neck portion of the reclosable hinged flap includes at least one pair of offset reverse cut score lines extending from the edge to the head portion of the reclosable hinged flap.

15. The carton of claim 14 wherein the neck portion of the reclosable hinged flap includes two pairs of offset reverse cut score lines extending from the edge to the head portion of the reclosable hinged flap.

16. The carton of claim 11 wherein the disengaging tab is scored for release.

17. The carton of claim 16 wherein the third side wall includes an inner surface and a separating area formed on the inner surface that surrounds and is connected to the disengaging tab.

18. The carton of claim 17 wherein the separating area has a trapezoidal shape.

19. The carton of claim 17 wherein the separating area overlaps and is connected to the head portion of the reclosable hinged flap.

20. A method of forming a carton with a reclosable hinged flap, the method comprising the steps of:

creating a blank having a first main panel, a second main panel, at least one side panel, at least two top flaps, at least two bottom flaps, a glue flap, an integrally formed disengaging tab, an integrally formed reclosable hinged flap having a head portion and a neck portion secured to the head portion, and a plurality of fold lines;

folding the blank along the plurality of fold lines to form a top wall, a bottom wall, and at least a first side wall, a second side wall and a third side wall, wherein the reclosable hinged flap is integral with the first side wall and the first side wall is adjacent to the glue flap;

adhering the glue flap to an inner surface of the third side wall while aligning the disengaging tab with the head portion of the reclosable hinged flap, wherein the head portion has a first height and a separation of the neck portion from the first side wall creates an opening having a second height which is less than the first height;

adhering the at least two bottom flaps to each other to form the bottom wall; and adhering the at least two top flap to each other to form the top wall and the carton.

21. A blank for forming a carton, comprising:

a first main panel having an inner surface and a separating area formed on the inner surface;

a second main panel connected to the first main panel;

a side panel connected to the second main panel along a line;

a glue flap connected to the side panel;

a reclosable hinged flap extending across the side panel and into the glue flap;

a disengaging tab integrally formed in the first main panel, wherein the disengaging tab is surrounded by and is connected to the separating area; and a plurality of end panels secured to the panels.

22. The blank of claim 21 wherein the separating area has a trapezoidal shape.

23. The blank of claim 21 wherein the first main panel has a top edge and the disengaging tab is a first distance down from the top edge of the first main panel, and wherein the glue flap has a top edge and the head portion of the reclosable hinged flap is substantially the first distance down from the top edge of the glue flap.

24. The blank of claim 21 wherein the blank is formed into a carton.

* * * * *

UNITED STATES PATENT AND TRADEMARK OFFICE

CERTIFICATE OF CORRECTION

PATENT NO. : 5,573,177

DATED : November 12, 1996

INVENTOR(S) : Graham Hough

It is certified that error appears in the above-indentified patent and that said Letters Patent is hereby corrected as shown below:

Column 5, line 49, "34a" should be 134a.
Claim 3, line 42, 1 should be inserted afer the word "claim."
Claim 11, line 6, insert the word side between the words "third" and "wall."
Claim 20, line 21, "flap" should be flaps.

Signed and Sealed this

Eleventh Day of March, 1997

*Attest:*

*Attesting Officer*

BRUCE LEHMAN

*Commissioner of Patents and Trademarks*